United States Patent [19]

Heinzer

[11] Patent Number: 4,752,043

[45] Date of Patent: Jun. 21, 1988

[54] METHOD OF AND APPARATUS FOR WINDING A PRECISION OPTICAL FIBER COIL

[75] Inventor: Hans E. Heinzer, Roanoke, Va.

[73] Assignee: U.S. Holding Company, Inc., New York, N.Y.

[21] Appl. No.: 794,903

[22] Filed: Nov. 4, 1985

[51] Int. Cl.[4] ..... B65H 54/02; B65H 59/00

[52] U.S. Cl. ..... 242/18 G; 242/18 R; 242/45; 242/159

[58] Field of Search ..... 242/18 G, 18 R, 45, 242/75.5, 75.51, 159, 174, 175, 176, 177, 178

[56] References Cited

U.S. PATENT DOCUMENTS

| | | | |
|---|---|---|---|
| 3,141,624 | 7/1964 | Gentle et al. | 242/18 R |
| 3,910,521 | 10/1975 | O'Callaghan et al. | 242/75.51 |
| 3,966,133 | 6/1976 | Gelin | 242/45 X |
| 4,494,702 | 1/1985 | Miyake et al. | 242/45 X |
| 4,508,284 | 4/1985 | Kataoka | 242/75.51 |

*Primary Examiner*—Stanley N. Gilreath

*Attorney, Agent, or Firm*—Christie, Parker & Hale

[57] ABSTRACT

During the formation of an optical fiber coil on an elongated rotationally symmetrical support element, the tension applied to the optical fiber as it is being wound into the coil is gradually or incrementally decreased as the superimposed layers of the optical fiber coil are being deposited on top of one another in the radially outward direction. Thus, the force applied to the fiber as it approaches the take-up location on the support element to achieve the desired longitudinal tension in the optical fiber may decrease from the range substantially betwen 150 to 300 grams initially to the range of substantially between 50 and 70 grams as the optical fiber coil nears completion. An apparatus for winding the optical fiber coil includes the arrangements needed for monitoring the progress of the winding operation and for adjusting the various parameters of such operation accordingly. An optical fiber coil arrangement obtained in this manner has very low optical losses even at extreme temperatures.

7 Claims, 2 Drawing Sheets

METHOD OF AND APPARATUS FOR WINDING A PRECISION OPTICAL FIBER COIL

BACKGROUND OF THE INVENTION

The present invention relates to optical fiber coils in general, and more particularly to a precision-wound optical fiber coil to be used, for istance, for rapid peel deployment of the optical fiber therefrom.

When winding optical fiber onto a bobbin or a similar support, there are several important requirements or conditions that are to be met. First of all, it must be assured that the optical properties of the optical fiber do not suffer as a result of the winding of the optical fiber onto the bobbin, particularly due to microbending losses or other phenomena which deleteriously influence the attenuation characteristic of the optical fiber. On the other hand, it is also important to assure that the optical fiber is wound onto the bobbin in an orderly fashion, that is, that the consecutive convolutions of the coil which are situated in the same layer of the coil are closely adjacent to one another if not in actual contact with each other, and that the convolutions of the next successive layer of the coil are partially received in the interstitial grooves between the convolutions of the preceding layer of the coil. These requirements are seemingly contradictory, inasmuch as it is necessary for the orderly laying of the optical fiber onto the bobbin or on the previously wound layer of the coil to impart a certain amount of tension to the optical fiber during the winding thereof, while this imparted tension results, either alone or in combination with stresses which are caused by differential thermal expansion of the bobbin relative to the coil wound thereon, in a considerable amount of stressing of the underlying layers of the coil by the layers which outwardly overlie the same, this stressing then resulting in deformations of the optical fiber in the underlying layers with attendant deterioration of the optical properties of the optical fiber in such layers, and thus of the optical fiber as a whole. Up to now, the optical fiber coils that have been wound with constant tension have suffered of one or another of the above drawbacks, which resulted in limited acceptance of such coils by the prospective users thereof.

SUMMARY OF THE INVENTION

Accordingly, it is a general object of the present invention to avoid the disadvantages of the prior art.

More particularly, it is an object of the present invention to provide a precision-wound optical fiber coil which does not suffer from the drawbacks of the known optical fiber coils.

Still another object of the present invention is to develop a method of winding a coil of the above type, which would result in the formation of coils that do not possess the above-mentioned disadvantages.

It is yet another object of the present invention to devise a method of the above type which is relatively simple and inexpensive to perform.

A concomitant object of the present invention is to devise an apparatus which is particularly suited for performing the above method.

Still another object of the present invention is to construct the apparatus of the type here under consideration so as to be relatively simple in construction, inexpensive to manufacture, easy to use, and reliable in operation nevertheless.

In pursuance of these objects and others which will become apparent hereafter, one feature of the present invention resides in a method of manufacturing a precision-wound optical fiber coil, which method comprises the steps of guiding a length of an optical fiber in a predetermined path to a take-up location; winding the optical fiber at the take-up location in a plurality of superimposed layers onto a rotating support element such that the optical fiber is subjected to tension in the longitudinal direction thereof as it approaches the take-up location; and controlling the longitudinal tension in the optical fiber in such a manner that this tension decreases as said winding step progresses.

A particular advantage obtained from the use of this method is that the respective outwardly located layers of the optical fiber in the coil are subjected to a lower tension than the layers located inwardly thereof, so that they will not exert as much force on the underlying layers as they would if they were wound at the same tension. This results in a substantial reduction in the optical fiber attenuation due to microbending losses. On the other hand, since the respective lower layers are wound with a tension exceeding that of the overlying layers, they are securely supported and the convolutions thereof are firmly held in place. Hence, it may be seen that the optical fiber coil of the present invention does not possess the disadvantages of any of the coils formed in accordance with previously known methods and using previously known apparatus.

BRIEF DESCRIPTION OF THE DRAWING

Above-mentioned and other features and objects of this invention will become more apparent by reference to the following description taken in conjunction with the accompanying drawings, in which.

DETAILED DESCRIPTION OF THE PREFERRED EMBODIMENTS

Figure 1:
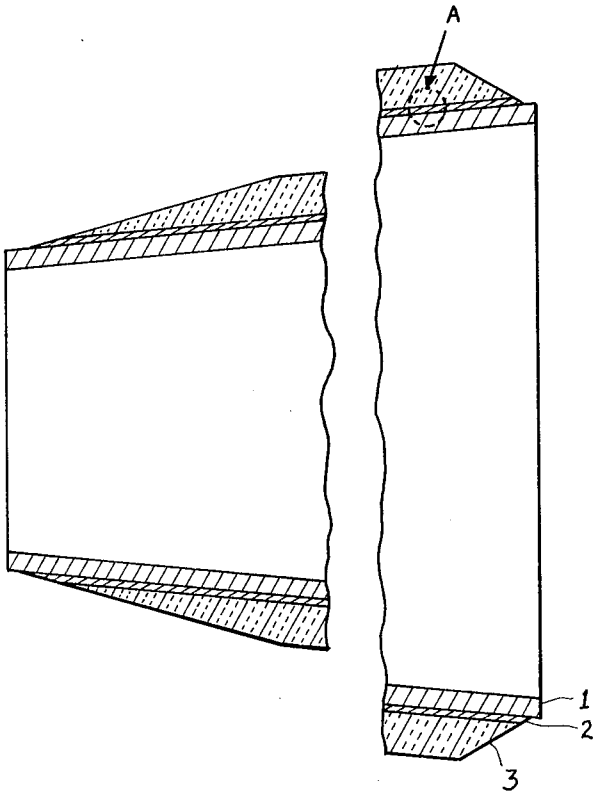
FIG. 1 is a fragmentary partially sectioned view of a precision-wound optical fiber coil arrangement of the present invention.

Referring now to the drawing in detail, and first to FIG. 1 thereof, it may be seen that the reference numeral 1 has been used therein to identify a bobbin or a similar rotationally symmetrical support element. A base layer 2 is shown to be provided at the outer circumferential surface of the bobbin 1, and an optical fiber coil 3 is shown to surround the base layer 2.

Figure 2:
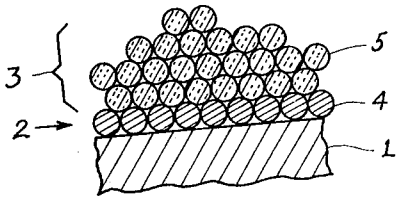
FIG. 2 is an enlarged view of a detail A of FIG. 1.

As shown particularly in FIG. 2 of the drawing, the base layer 2 is constituted by a wire or a similar elongated element 4 with a substantially circular cross section, the elongated element 4 being tightly wound onto the underlying bobbin 1 and, if need be, secured thereto by an adhesive or in any other known manner. The elongated element 4 has such a diameter that the adjacent turns or convolutions thereof abut one another, thus preventing movement of such convolutions in the axial direction of the bobbin 1.

It may also be seen in FIG. 2 that the optical fiber coil 3 includes a length of a cross-sectionally circular optical fiber 5 which is wound in a multitude of turns or convolutions first onto the base layer 2 and then in radially outwardly superimposed layers onto the respective previously wound optical fiber layers. The optical fiber 5 advantageously has a diameter which is slightly smaller than that of the elongated element 4, so that the adjacent or successive turns thereof which are situated in the same layer of the optical fiber coil 3 do not touch one another, except when, because of the variations of the outer diameter of the optical fiber 5 which do occasionally occur due to unavoidable imperfections encountered during the manufacture of the optical fiber 5, the diameter of the optical fiber 5 is locally the same as the diameter of the elongated element 4. To avoid the possibility that the adjacent convolutions of the elongated element 4 would unduly press against one another with possible attendant displacement of one or more such convolutions out of their desired positions at a region of the optical fiber coil 3 at which the outer diameter of the optical fiber 5 is at its maximum, the diameter of the elongated element 4 is so chosen as to be at least equal to the maximum possible diameter of the optical fiber 5.

It may further be seen in FIG. 2 of the drawing that the convolutions of the optical fiber 5 are partially received or nested in the grooves formed between the adjacent convolutions of either the elongated element 4 or of the previously wound layer of the optical fiber 5. Because of this, and particularly because of the presence of the tightly wound base layer 2 which does not permit axial shifting of the convolutions of the elongated element 4, there is avoided so-called slumping of the optical fiber coil 3, that is, spreading of respective adjacent convolutions of an underlying layer of the optical fiber 5 and introduction of at least one convolution from the overlying layer between the thus spread convolutions of the underlying layer, with similar or even worsening effect in the next overlying layers. The optical fiber 5 is illustrated in FIG. 2 as an uncoated optical fiber. However, in most instances, the optical fiber 5 will be provided with an outer coating or jacket of a synthetic plastic material which provides mechanical and/or chemical protection for the optical fiber 5 proper. Furthermore, FIG. 2 illustrates the convolutions of the optical fiber 5 to be merely situated adjacent one another. In practice, however, it will often be preferred to fix such convolutions in position by applying an adhesive thereto during the progress or at the conclusion of the formation of the respective layer of the optical fiber coil 3.

It will be appreciated that, once a layer of the optical fiber coil 3 in which the convolutions of the optical fiber 5 have the same sense of winding or pitch direction as the elongated element 4 of the base layer 2 is completed, it is necessary to bring the optical fiber 5 substantially to the starting point of the immediately preceding layer. This is advantageously achieved by winding the next succeeding layer of the optical fiber 5 generally in a direction opposite to that in which the preceding layer of the optical fiber coil 3 has been wound. This means that the optical fiber 5 of the next succeeding layer will have to cross the optical fiber 5 of the immediately preceding layer of the optical fiber coil 3 at a multitude of cross-over points. Such cross-over points present an increased danger of microbending losses and similar deleterious phenomena.

To avoid or at least reduce this danger, the optical fiber coil 3 is wound onto the bobbin 1 in such a manner that microbending losses, particularly at the cross-over points of the optical fiber convolutions especially near the bobbin 1, are reduced. According to the present invention, this has been achieved by applying a decreasing tension profile to the winding operation. More particularly, the tension applied to the optical fiber 5 during the winding of the optical fiber coil 3 on the bobbin 1 is gradually, periodically or occasionally reduced, such as from one layer of the optical fiber coil 3 to the next as considered in the outward direction of the optical fiber coil 3, by a selected amount. The amount of the tension reduction may be the same, or may vary, from one layer to another, to obtain either a substantially linear or another, such as logarithmic or exponential, dependence of the tension applied to the optical fiber 5 during the winding of the successive layers of the optical fiber coil 3 on the distance of the layers from the exterior of the bobbin 1. The tension reduction diminishes the radial forces pressing down on the underlying layers of the optical fiber 5 as the optical fiber coil 3 is being built up in the radially outward direction. Also, it appears that this reduction in tension is an important factor in reducing fiber slumping after post temperature treatment to finished optical fiber bobbin.

The following Table I shows the results of comparison of optical fiber coils wound at a constant tension with those fabricated in accordance with the present invention, that is, with radially decreasing and especially lineraly decreasing tension applied to the optical fiber 5 during the winding of the optical fiber coil 3. It may be seen from this Table that a rather dramatic reduction in the fiber attenuation is obtained both for single mode and multimode optical fibers when the optical fiber coil 3 is precision wound in accordance with the present invention with radially decreasing tension as compared to the attenuation obtained when the coil is wound at a constant tension.

TABLE I

FIBER ATTENUATION VERSUS TENSION
(All Data at 1300 nm)

| | Constant Tension 10 km Multimode | Constant Tension 11.2 km Single Mode | Tapered Tension 10.9 km Multimode | Tapered Tension 1.8 km Single Mode |
|---|---|---|---|---|
| Room Temperature | 1.39 dB/km | 0.55 dB/km | 0.58 dB/km | 0.54 dB/km |
| −32° C. | 3.05 dB/km | 0.88 dB/km | 1.35 dB/km | 0.64 dB/km |
| Attenuation | 1.66 dB/km | 0.33 dB/km | 0.77 dB/km | 0.1 dB/km |

Figure 3:
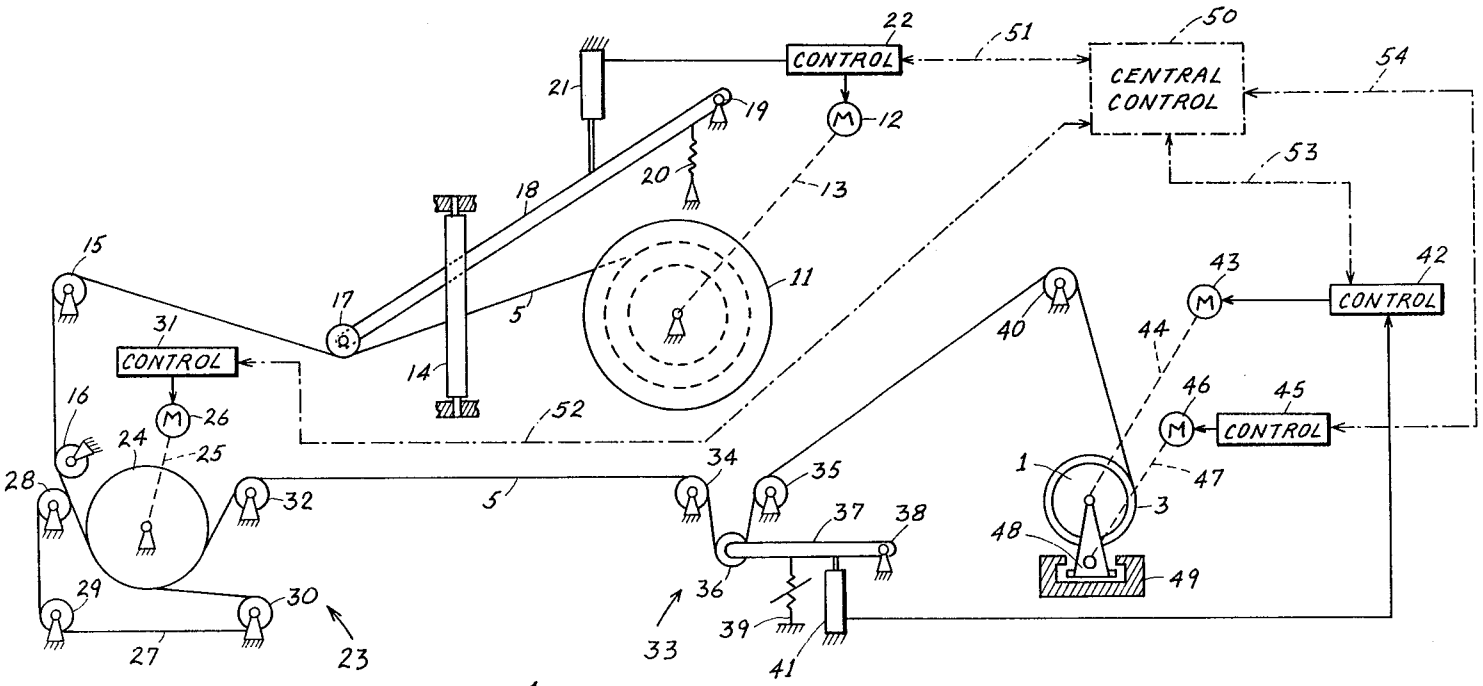
FIG. 3 is a somewhat diagrammatic side elevational view of an apparatus of the present invention for winding the coil of FIG. 1.

Turning now to FIG. 3 of the drawing, it may be seen that the reference numeral 10 has been used therein to denote a precision winding apparatus in its entirety. The precision winding apparatus 10 is so constructed as to be able to perform the above-discussed method of the present invention, that is, to precision-wind the optical fiber coil 3 of the optical fiber 5 in a multitude of superimposed layers onto the bobbin 1 with the radially outwardly decreasing tension. In the following description, the precision winding apparatus 10 of the present invention will be discussed as being used for the purpose for winding an outer-peel rapid-deployment optical fiber coil 3 of the optical fiber 5 onto a bobbin 1 with a frusto-conical configuration; however, it will be appreciated that the precision winding apparatus 10 can also be used for winding elongated formations other than optical fibers into coils supported on bobbins or mandrels, that the optical fiber coil 3 need not necessarily be of the outer peel rapid deployment type, and that the shape of the bobbin 1 need not be frusto-conical in all cases.

As mentioned before, there are certain requirements to be met when winding the optical fiber 5 on the bobbin 1, and the precision winding apparatus 10 is particularly suited to satisfy such requirements when its operation is controlled in accordance with the present invention. To accomplish this control, the precision winding apparatus 10 is provided with several control arrangements which will be discussed below and the operation of which is controlled in accordance with the present invention. A relatively simple construction of the precision winding apparatus 10 that is capable of performing in accordance with the present invention but in which the various control arrangements have rather simple constructions and work independently from one another will now be discussed in conjunction with FIG. 3 of the drawing for elucidating the principles of the construction and operation of the precision winding apparatus 10. However, it should become apparent as the present description proceeds that the various control arrangements could be interconnected or linked with one another so as to provide for a more sophisticated control of the precision winding apparatus 10 with an improved operation of the precision winding apparatus 10 especially as far as the accommodation of the operation of the precision winding apparatus 10 to the progress of the winding operation is concerned.

In the precision winding apparatus 10 as illustrated in FIG. 3, the optical fiber 5 to be wound into the optical fiber coil 3 on the bobbin 1 is payed out from a payout reel 11. The payout reel 11 is mounted for rotation about its axis and the speed of its rotation can be controlled. As shown, the rotation of the payout reel 11 is effected by a first motor 12, especially an electric motor, the rotor of which is mechanically connected, by means of a connection 13 such as a shaft, with the payout reel 11 for joint rotation. The optical fiber 5 payed out from the payout reel 11 first passes between two elongated guiding rollers 14 which are mounted for turning about respective axes that are substantially parallel to one another and to the plane of the drawing and that extend transversely with respect to the path of movement of the optical fiber 5. The main function of the guiding rollers 14 is to confine the optical fiber 5 at this location to movement basically in the plane of the drawing, despite the fact that the payout point, that is, the point at which the optical fiber 5 leaves the payout reel 11, moves in the axial direction of the payout reel 11. After being so stabilized by the guiding rollers 14, the optical fiber 5 moves on toward a first diverting pulley 15 at which it is diverted to continue its travel toward a second diverting pulley 16.

A so-called dancer roller 17 contacts the optical fiber 5 between the guiding rollers 14 and the first dirverting pulley 15. The dancer roller 17 is mounted on a mounting lever 18 which bypasses the guiding rollers 14 and is mounted for pivoting about a stationary pivoting axis 19. A spring 20 urges the mounting lever 18 in the counterclockwise direction as considered in the drawing, thus causing the dancer roller 17 to contact the optical fiber 5 and deflect the same to a greater or lesser degree from a straight course interconnecting the payout point with the circumference of the first diverting pulley 15, ending on the force exerted by the spring 20 and the tension in the optical fiber 5.

The extent of the pivotal movement of the mounting lever 18 is sensed by a first sensing arrangement 21 which is of a conventional construction and which generates a first control signal, especially an electrical signal, which is representative of the extent of such excursion of the mounting lever 18. This first control signal is then supplied to a first control arrangement 22 which uses this first control signal in a conventional manner to control the speed of rotation of the rotor of the first motor 12 and thus of the connection 13 and the payout reel 11. This provides a negative feedback loop in that a reduced tension in that section of the optical fiber 5 which is situated between the payout reel 11 and the first diverting pulley 15 results in an increased excursion of the mounting lever 18 which, in turn, results via the control of the speed of the first motor 12, as provided by the first control arrangement 22 in response to the first control signal issued by the first sensing arrangement 21, in a reduced speed of rotation of the payout reel 11 and thus in an increase in the tension of the section of the optical fiber 5 situated between the payout reel 11 and the first diverting pulley 15.

Of course, for the above-discussed tension control to work, an action or pulling force of substantially the same magnitude as that of the instantaneous reaction or braking force applied to the optical fiber 5 by the payout reel 11 but acting in the opposite longitudinal direction of the optical fiber 5 must be applied to the optical fiber 5 downstream of the second diverting pulley 16. This action force is applied by an intermediate drive that is generally identified by the reference numeral 23 and that includes an intermediate drive pulley 24 which is connected, by means of a mechanical connection 25, such as a shaft, for joint rotation with the rotor of a second motor 26, advantageously again an electric motor. The optical fiber 5 is trained about a part of the periphery of the intermediate drive pulley 24. It is desired that there be no slippage between the optical fiber 5 and the outer peripheral surface of the intermediate drive pulley 24, since any such slippage would adversely affect the tension which is to be maintained in the optical fiber 5 either upstream of or downstream of the intermediate drive pulley 24, so that the friction between the optical fiber and the intermediate drive pulley 24 must be maintained at a relatively high level. To increase such friction, the intermediate drive pulley 24 may be made in its entirety of a high-friction material, that is, a material which has a high coefficient of friction with respect to the material present at the outer surface of the optical fiber 5, or provided at least at its outer periphery with a layer of such high-friction material. Furthermore, as also illustrated in FIG. 3 of the drawing, to further enhance the frictional entrainment of the optical fiber 5 for joint travel with the outer periphery of the intermediate drive pulley 24, there is provided an endless element 27, advantageously a belt, preferably again of a high-friction material, which is trained about pulleys or rollers 28, 29 and 30 and confines the optical fiber 5 between itself and the outer periphery of the intermediate drive pulley 24, thus pressing the optical fiber 5 against the high-friction outer circumferential surface of the intermediate drive pulley 24.

The speed of rotation of the second motor 26, which is advantageously constructed as a variable-speed motor, and thus the speed of rotation of the intermediate drive pulley 24, is controlled by a second control arrangement 31. Usually, this speed is selected by the operating personnel in dependence on known criteria, such as the desired winding speed, the dimensions and/or material of the optical fiber 5, or the like. However, as will be explained later, this speed, once selected, need not remain invariable during the optical coil winding operation; rather, it may vary with the progress of such operation. In any event, this speed may constitute a basis for the control of the operation of other components of the precision winding apparatus 10, as will also be explained later.

After leaving the intermediate drive pulley 24, the optical fiber 5 is trained about another diverting pulley or roller 32 from where it progresses to a tension-detecting arrangement generally designated by the reference numeral 33. The intermediate drive pulley 24, due to its frictional engagement with the optical fiber 5, provides a reaction force that is needed for the proper operation of the tension-detecting arrangement 33 and for the successful winding of the optical fiber coil 3. The tension-detecting arrangement 33 includes two additional diverting rollers or pulleys 34 and 35 and a tensioning roller or pulley 36. The diverting pulleys 34 and 35 are mounted for rotation about respective stationary axes, while the tensioning pulley 36 is mounted for rotation about an axis substantially parallel to those of the diverting pulleys 34 and 35 on a lever 37 that is mounted for pivoting about a stationary axis 38. The lever 37 is acted upon by a spring 39 which may be adjustable as to the force which it exerts on the lever 37. The optical fiber 5 is threaded through the tension-detecting arrangement 33 in such a manner that it is first trained about the diverting pulley 34, then about the tensioning pulley 36, and finally about the diverting pulley 35, from where it proceeds toward a further stationary mounted rotatable pulley or roller 40 and partially around the same to its ultimate destination at the exterior of the base layer 2 or the outer layer of the optical fiber 5 that has been previously wound onto the base layer 2 and surrounds the bobbin 1.

The instantaneous pivoted position of the lever 37 about the stationary axis 38 is sensed or detected by a second sensing arrangement 41 of a conventional construction which issues a second control signal, advantageously an electrical signal, which is representative of the instantaneous pivoted position of the lever 37. This second control signal is then used, in a manner which will be discussed later, for controlling the coil winding operation proper and particularly the tension at which the optical fiber 5 is being wound at any particular point in time. As shown in FIG. 3, the second control signal is supplied to a third control arrangement 42 that controls the operation of a third motor 43 that has an output element 44, especially an output shaft, which drives the bobbin 1 in rotation about its longitudinal axis. In this construction, the third control arrangement 42 so uses the second control signal that the speed of rotation of the bobbin 1 with the output element 44 is proportional to the magnitude of the second control signal. Since the speed of advancement of the optical fiber 5 is determined by the intermediate drive 23 due to the no-slip conditions prevailing thereat, this results in an amount of tension in the optical fiber 5 which is maintained at substantially the same predetermined level due to the feedback between the tension-detecting arrangement 33 and the third control arrangement 42, this level being determined by the third control arrangement 42 based on the progress of the winding operation.

FIG. 3 also shows that there is provided a fourth control arrangement 45 which controls a fourth motor 46 that is connected, by an output element 47, with a support 48 on which the bobbin 1 is mounted for rotation and which is movable in or on a guide 49 for movement parallel to the direction of the axis of rotation of the bobbin 1. The output element 47 is so connected, in any known manner, with the support 48 as to cause the desired movements of the latter in opposite longitudinal directions of the guide 49, which movements are coordinated with and, in the final analysis, determinative of the progress of the winding operation. Therefore, it is imperative for the successful performance of the optical fiber coil winding operation proposed by the present invention that at least the third control arrangement 42 but preferably also the fourth control arrangement 45 be so constructed as to be able to keep track of the progress of the winding operation. This may be achieved on an individual basis by providing the third control arrangement 42 and the fourth control arrangement 45 with individual memories and/or counters which are set at the beginning of the winding operation and then incremented as the winding operation of the respective bobbin 1 proceeds.

However, it is also possible and contemplated by the present invention, in accordance with an advantageous concept thereof, to centrally supervise and control the operation of the control arrangements 22, 31, 42 and 45 or directly the operation of the motors 12, 26, 43 and 46 based on the information derived either from the control arrangements 22, 31, 42 and 45 or directly from the respective sensing arrangements 21 and 33. This possibility is indicated in FIG. 3 in phantom lines and, as shown, involves the provision of a central control unit or arrangement 50 which is connected by bidirectional (command and feedback) lines 51, 52, 53 and 54 with the respective control arrangements 22, 31, 42 and 45. In this case, the central control unit 50 keeps track of the progress of the winding operation and controls the operation of the control arrangements 22, 31, 42 and 45 accordingly. All this can be achieved, in a manner well known to those versed in the field of computer-controlled machinery, by appropriately programming a general-purpose computer or appropriately configuring a special-purpose computer or control unit.

Regardless of which of the above-mentioned individual and central control approaches is chosen, appropriate correlations will have to be established between the advancement speed as determined by the second control arrangement 31, on the one hand, and the payout speed as determined by the first control arrangement 22, the speed of rotation of the bobbin 1 as determined by the third control arrangement 42, and the tension of the optical fiber 5 at the point of its deposition or take-up onto the bobbin 1, on the other hand. When the approach illustrated in FIG. 3 and discussed above is used, at least the last-mentioned correlation will have to change with the progress of the winding operation as contemplated by the present invention. The information needed for establishing such correlations may be stored in and gradually released by the central control unit 50 in dependence on the progress of the coil-winding operation, or can be individually stored in and gradually utilized by the individual control arrangements 22, 31, 42 and 45 in dependence on the progress of the winding operation since the resetting of the control arrangements 22, 31, 42 and 45 at the beginning of the respective winding operation, especially in the event that no central control unit 50 is provided. It is not believed to be necessary to explain here exactly how such storage and release or utilization occur, since those active in the above-mentioned field will be readily able to come up with the appropriate components capable of accomplishing these tasks.

It is to be mentioned that, if so desired, the control action of the first control arrangement 22 could be performed independently of the progress of the winding operation. Moreover, the control action performed by the second control arrangement 31 could also be independent of the progress of the winding operation, in which case the advancement speed of the optical fiber 5 as determined by the second control arrangement 31 would be maintained constant over the entire course of the winding operation and would form a basis for the control actions of the control arrangements 22, 42 and 45. Yet, it would also be possible, as contemplated, to vary the advancement speed as determined by the second control arrangement 31 as the winding operation progresses, for instance, to take into account the increasing diameter of the optical fiber coil 3 being formed on the bobbin 1. In this case, the speed of rotation of the bobbin 1 as determined by the third control arrangement 42 could be, for instance, maintained substantially constant, regardless of the advancement speed of the optical fiber 5. Furthermore, it would be possible, as also contemplated by the present invention, to make the operation of the third control arrangement 42 independent of the progress of the winding operation, with attendant simplification of the construction or programming of the third control arrangement 42, since then the speed of operation of the third motor 43 will merely have to track the advancement speed of the optical fiber 5 as determined by the second control arrangement 31. This can be accomplished either by using manual adjustment of the force which the adjustable spring 39 exerts on the lever from time to time as the winding operation proceeds, or by utilizing the second signal issued by the second sensing arrangement 41 for achieving such adjustment by means of a suitable drive or the like. In any event, the equipment which will be used to accomplish the above-mentioned tasks is readily available to and well known by those active in this field.

It is to be reiterated that it is important in the context of the present invention that the tension at the point of take-up of the optical fiber 5 onto the bobbin 1 does not remain constant over the entire course of the optical fiber coil winding operation, but rather that it is adjusted as the winding operation proceeds toward lower tension levels either gradually or in a stepped manner. Advantageously, the tension at the take-up point is so adjusted that at the beginning of the coil-winding operation, the optical fiber 5 is deposited onto the bobbin 1 with a force of between about 150 and 300 grams applied thereto and this force is reduced in a gradual or stepped manner until it has reached the level of between approximately 50 and 70 grams at the end of the coil-winding operation. The optical fiber 5 is advantageously deposited onto the bobbin 1 at a speed of between approximately 50 and 150 meters per minute.

It is particularly advantageous when the motors 12, 26, 43 and 46 are constructed as or incorportated in stepped drives, since then the control of the operation is particularly easy, since the control arrangements 22, 31, 42 and 45 can be constituted by digital processing equipment, and the digital output signals thereof can be directly used for controlling the operation of the motors 12, 26, 43 and 46.

While I have described above the principles of my invention in connection with specific apparatus, it is to be clearly understood that this description is made only by way of example and not as a limitation to the scope of my invention as set forth in the objects thereof and in the accompanying claims.

I claim:

1. A method of manufacturing a precision-wound optical fiber coil, comprising the steps of:

guiding a length of an optical fiber in a predetermined path to a take-up location;

winding the optical fiber at the take-up location in a plurality of superimposed layers onto a rotating support element such that the optical fiber is subjected to tension in the longitudinal direction thereof as it approaches the take-up location;

applying to the optical fiber a force effective in the longitudinal direction of the optical fiber; and decreasing said force from a range substantially between 150 and 300 grams at the commencement of said winding step to a range substantially between 50 and 70 grams at the termination of said winding step, whereby the longitudinal tension in the optical fiber decreases as said winding step progresses.

2. The method as defined in claim 1, wherein said decreasing step includes gradually decreasing said force in proportion to the progress of said winding step.

3. The method as defined in claim 1, wherein said decreasing step includes decreasing said force in incremental steps during the performance of said winding step.

4. The method as defined in claim 3, wherein said decreasing of said force is performed after the formation of respective layers of the coil.

5. The method as defined in claim 1, wherein said decreasing of said force is performed substantially linearly.

6. The method as defined in claim 1, wherein said decreasing of said force is performed at a varying pace.

7. An apparatus for manufacturing a precision-wound optical fiber coil, comprising means for guiding a length of an optical fiber in a predetermined path to a take-up location;

means for winding the optical fiber at the take-up location in a plurality of superimposed layers onto a rotating support element such that the optical fiber is subjected to tension in the longitudinal direction thereof as it approaches the take-up location; and means for controlling the longitudinal tension in the optical fiber in such a manner that this tension decreases as the winding of the optical fiber onto the rotating support progresses, said controlling means including means for applying to the optical fiber a force effective in the longitudinal direction of the optical fiber and decreasing from a range substantially between 150 to 300 grams at the commencement of the formation of the optical fiber coil to a range substantially between 50 and 70 grams at the termination of the formation of the optical fiber coil.

* * * * *

UNITED STATES PATENT AND TRADEMARK OFFICE

CERTIFICATE OF CORRECTION

PATENT NO. : 4,752,043

DATED : June 21, 1988

INVENTOR(S) : Heinzer

It is certified that error appears in the above-identified patent and that said Letters Patent is hereby corrected as shown below:

Column 6 Line 3 Change "ending" to -- depending --

Signed and Sealed this

Twentieth Day of December, 1988

*Attest:*

DONALD J. QUIGG

*Attesting Officer*

*Commissioner of Patents and Trademarks*